US011060289B2

(12) United States Patent
Doyle

(10) Patent No.: US 11,060,289 B2
(45) Date of Patent: Jul. 13, 2021

(54) THATCH ROOFING SYSTEM

(71) Applicant: Brendan Doyle, Pacific Grove, CA (US)

(72) Inventor: Brendan Doyle, Pacific Grove, CA (US)

(73) Assignee: Brendan Doyle, Pacific Grove, CA (US)

( * ) Notice: Subject to any disclaimer, the term of this patent is extended or adjusted under 35 U.S.C. 154(b) by 0 days.

(21) Appl. No.: 16/753,946

(22) PCT Filed: Oct. 23, 2018

(86) PCT No.: PCT/US2018/056992

§ 371 (c)(1),
(2) Date: Apr. 6, 2020

(87) PCT Pub. No.: WO2019/083927

PCT Pub. Date: May 2, 2019

(65) Prior Publication Data

US 2020/0308838 A1 Oct. 1, 2020

Related U.S. Application Data

(60) Provisional application No. 62/577,865, filed on Oct. 27, 2017.

(51) Int. Cl.
*E04D 9/00* (2006.01)
*E04D 13/04* (2006.01)

(52) U.S. Cl.
CPC ..... *E04D 9/00* (2013.01); *E04D 13/0409* (2013.01); *E04D 13/0459* (2013.01); *E04D 2013/049* (2013.01); *E04D 2013/0413* (2013.01); *E04D 2013/0427* (2013.01)

(58) Field of Classification Search
CPC ..... E04D 9/00; E04D 13/04; E04D 13/0409; E04D 13/0459; E04D 2013/0413; E04D 2013/0427; E04D 2013/049; E04D 13/17
See application file for complete search history.

(56) References Cited

U.S. PATENT DOCUMENTS 233,269 A * 10/1880 McClelland ..... E04D 9/00 52/750
370,984 A * 10/1887 Steddom, Jr. ..... E04D 9/00 52/750
509,751 A 11/1893 Mandeville
(Continued)

FOREIGN PATENT DOCUMENTS

CN 201679159 * 12/2010
CN 204781527 * 11/2015
(Continued)

*Primary Examiner* — James M Ference
(74) *Attorney, Agent, or Firm* — Lumen Patent Firm

(57) ABSTRACT

A modular thatch panel for a thatch roof is provided that distinguishes a perforated louvered drainage and drying tray and an insert thatch bale. The tray has louvers at the bottom aspect of the tray and perforations distributed over the tray bottom. The bottom surface of the tray faces a barrier (e.g. water, thermal and/or fire) which overlays a roof panel. The tray and the barrier are at a distance suitable for airflow in between the two layers. The insert thatch bale is compacted, bonded and inserted in the perforated louvered drainage and drying tray.

6 Claims, 1 Drawing Sheet

(56) References Cited

U.S. PATENT DOCUMENTS 1,492,610 A * 5/1924 Simpson ..... E04D 9/00 52/518
3,939,616 A * 2/1976 Schapker ..... E04D 13/0459 52/94
4,140,825 A * 2/1979 Koschorrek ..... E04D 3/35 156/435
4,583,344 A * 4/1986 Butler ..... E04D 5/10 428/17
4,611,451 A * 9/1986 Symbold ..... E04D 9/00 52/555
4,739,603 A * 4/1988 Butler ..... E04D 9/00 428/17
4,800,675 A * 1/1989 Feil ..... E04D 1/30 47/33
5,333,431 A * 8/1994 Houpt ..... E04D 9/00 428/141
5,946,854 A * 9/1999 Guillemain ..... A01G 24/00 47/65.9
6,226,949 B1 * 5/2001 Huber ..... E04D 9/00 428/17
6,606,823 B1 * 8/2003 McDonough ..... H02S 20/24 47/65.9
6,715,251 B2 * 4/2004 Yang ..... E04D 9/00 428/17
7,735,275 B2 * 6/2010 Vandewater, Jr. .... E04D 12/006 52/302.1
8,122,682 B2 * 2/2012 Mischo ..... A01G 9/033 52/747.1
9,097,019 B1 * 8/2015 Rasmussen ..... E04B 1/40
9,265,200 B2 * 2/2016 Buist ..... A01G 9/027
9,790,687 B1 * 10/2017 Valinejadshoubi ..... E04D 13/04
2002/0007593 A1 * 1/2002 Mischo ..... A01G 9/033 47/86
2004/0031213 A1 * 2/2004 Huber ..... E04D 13/1585 52/96
2004/0074164 A1 * 4/2004 Behrens ..... H01Q 1/52 52/173.1
2005/0044791 A1 * 3/2005 Morandini ..... A01G 9/00 47/65.9
2005/0285293 A1 * 12/2005 Brown ..... E04D 9/00 264/51
2006/0052051 A1 3/2006 Daniels
2006/0179761 A1 * 8/2006 Burg ..... E04B 2/7453 52/481.1
2006/0179763 A1 * 8/2006 Burg ..... E04B 2/7457 52/506.01
2007/0079547 A1 * 4/2007 Gold ..... A01G 9/033 47/18
2007/0157514 A1 * 7/2007 Carpenter ..... A01G 9/033 47/65.9
2008/0168710 A1 * 7/2008 MacKenzie ..... A01G 9/022 47/65.9
2008/0236041 A1 * 10/2008 Carpenter ..... E04D 11/002 47/65.9
2009/0260284 A1 * 10/2009 Barbalho ..... A01G 9/033 47/65.9
2010/0180530 A1 * 7/2010 Lee ..... E04H 6/025 52/460
2011/0030274 A1 * 2/2011 Buist ..... A01G 9/033 47/65.6
2011/0088338 A1 * 4/2011 White ..... E04C 2/18 52/146
2011/0197523 A1 * 8/2011 Dubner ..... A01G 9/033 52/173.1
2011/0289839 A1 * 12/2011 Cronk ..... A01G 9/033 47/65.7
2013/0255173 A1 * 10/2013 Valentine ..... B29C 48/00 52/309.1
2013/0298463 A1 * 11/2013 Ke ..... A01G 9/033 47/79
2015/0121779 A1 * 5/2015 Arguelles ..... E04D 12/002 52/173.1
2016/0108621 A1 * 4/2016 Zwier ..... E03F 1/005 220/571
2016/0135381 A1 * 5/2016 Garner ..... A01G 9/033 47/65.9
2017/0245441 A1 * 8/2017 Kirkley ..... A01G 9/028
2020/0308838 A1 * 10/2020 Doyle ..... E04D 13/04

FOREIGN PATENT DOCUMENTS

DE 102008062288 A1 * 2/2010 ..... E04D 13/174
DE 102009035035 * 3/2011
EP 0377001 A1 * 7/1990 ..... E04D 3/32
GB 190006595 * 3/1901
JP 2005016109 * 1/2005

* cited by examiner

THATCH ROOFING SYSTEM

CROSS-REFERENCE TO RELATED APPLICATIONS

This application is a 371 of PCT application PCT/US2018/056992 filed Oct. 23, 2018. PCT application PCT/US2018/056992 claims the benefit of U.S. Provisional application 62/577,865 filed Oct. 27, 2017.

FIELD OF THE INVENTION

This invention relates to thatch roofing systems, devices and methods.

BACKGROUND OF THE INVENTION

Current practice in roof thatching indicates that thatching materials used must be of durable structural quality, have low-porosity, and be of sufficient length for effective overlapping to prevent rainwater from penetrating the thatch layer and entering the building. To safeguard these qualities, the harvesting of thatching materials requires delicate treatment—a process considered best undertaken by hand. This is particularly pertinent to the harvesting of fragile varieties of straw or hay. Conversely, modern harvesting techniques tend to crack and weaken straw or hay stalks, and renders it unsuitable, in its present form, for roof thatching because it would allow rainwater to permeate the roofing and building structure. This causes premature onset of mold and rot in the thatch and structural damage to the building.

The thatching industry suffers from various problems and issues, which could be summarized as follows:

- Diminishing availability and rising costs of suitable natural roof thatching materials;
- Shortage of skilled traditional thatchers and the long waiting times for thatch roof construction and/or repairs;
- Growing decline in quality of thatch roof construction due to shortages of experienced thatchers, as well as insufficient quality controls in the thatching industry;
- Excessive construction time and prohibitive cost of traditional roof thatching;
- Higher fire risk associated with natural thatched roofs and subsequent insurance costs;
- Damage risk to interior of building structure when traditional thatch roofs fail to keep out water or wind or vermin from entering the building;
- Limitation of roof-pitch options associated with traditional thatch roof construction (typically 45 degrees and upwards).

Accordingly, there is a need to develop a new-age thatch roofing system to overcome many of the current limitations and risks associated with traditional natural thatched roofs design and construction.

SUMMARY OF THE INVENTION

The present invention provides a modular thatch panel for a thatch roof that distinguishes a perforated louvered drainage and drying tray and an insert thatch bale. The tray has louvers at the bottom aspect of the tray and perforations distributed over the tray bottom. The bottom surface of the tray faces a barrier (e.g. water, thermal and/or fire) which overlays a roof panel. The tray and the barrier are at a distance suitable for airflow in between the two layers. The insert thatch bale is compacted, bonded and inserted in the perforated louvered drainage and drying tray. The tray could also have additional sides defined parallel with respect to the roof line. All the sides of the tray could also have perforations mostly for weight reduction.

Embodiments of the invention have the following advantages:

- The utilization of abundant supply of locally modern-harvested natural straw or hay (of various varieties) heretofore, considered unsuitable for traditional thatching—thus reducing high current costs and transportation of scarce hand-harvested thatching materials from distant locations;
- The simplification of roof thatching by utilizing modern building techniques commonly understood and practiced by general building contractors and DIY type persons to undertake such work;
- The preassembling, to modern building standards, of all thatching components within a controlled environment for further use by general builders and DIY type persons;
- Cost reductions by utilizing more affordable locally available thatching materials, by pre-assembling modular thatch panels and by making construction simple and faster through using modern building techniques known and practiced by general building contractors and DIY type persons;
- The utilization of a modern under-roof having an integrated fire barrier included into the overall thatching system;
- The utilization of a modern under-roof with integrated rain, thermal and fire barriers, and combined with a rainwater drainage system—to safely prevent water, wind or vermin from entering the building structure;
- By combining a modern under-roof and rainwater drainage system with that of a plurality of perforated and louvered thatch panels—thus safely allowing lower roof pitch options down to 30 degrees and further allowing most existing modern roofs to be thatched using the innovation.

BRIEF DESCRIPTION OF THE DRAWINGS

FIG. 1 shows a sectional view of the insert thatch bale 150 (solid circles) compacted, bonded and inserted in the perforated louvered drainage and drying tray 110 where the bottom surface of the insert thatch bale 150 faces the bottom of the perforated louvered drainage and drying tray 110. The insert thatch bale 150 would fill the entire tray 110 and depending on the application extend beyond one or more of the sides. It is noted that only part of the insert thatch bale 150 is shown to maintain clarity of the concept. The side surfaces of the insert thatch bale 150 face at least two sides 140 of the perforated louvered drainage and drying tray 110. In an alternate embodiment, the tray 110 could also have sides at either end (not shown).

DETAILED DESCRIPTION

Figure 2:
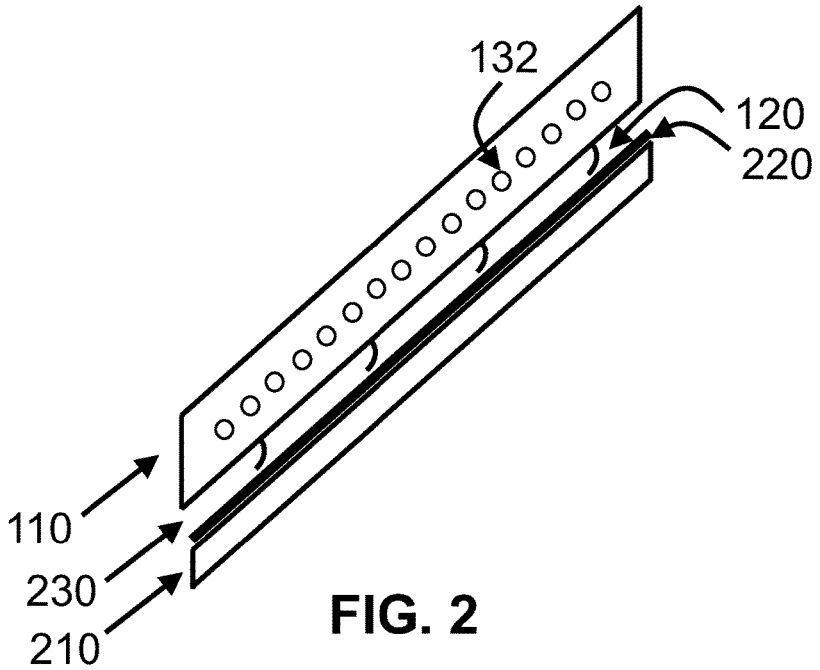

Embodiments of this present invention makes use of modern harvested straw and/or hay (of various varieties) currently deemed unsuitable for traditional and contemporary roof thatching. This is achieved by turning on its head the concept of thatch having to provide the building structure's impervious water barrier. The invention overcomes this concept by combining and affixing an aesthetically pleasing natural outer thatch shell to that of a modern roof which provides the critical water, fire, and thermal barriers (e.g. 220, FIG. 2).

The outer thatch shell and inner modern roof are securely fixed together in a manner that allows a suitable upwards airflow space 230 between the two components to facilitate quick drying of the thatch panel following precipitation.

Embodiments of this invention also enables a concealed water drainage system attached to the inner modern roofing component to safely and efficiently drain off any moisture (or water) that might percolate through the outer thatch shell during heavy or prolonged periods of precipitation.

The outer thatch shell is made of a plurality of individual thatched modular panels of which each thatch panel is prefabricated by compacting modern harvested straw or hay to a desired thickness (from 2 to 6 inches thickness) to maximize rainwater runoff from the outer thatch shell surface and compression (determined by the type and characteristics of the straw or hay) and securely attaching it to a perforated louvered tray of sheet metal, plastic or composite. Each perforated louvered drainage and drying tray is designed specifically to allow efficient drainage of moisture during heavy or prolonged periods of precipitation to safely percolate downwards through the thatch panel and drain into the concealed internal drainage system.

Likewise, the design of the perforated louvered drainage and drying tray also acts to efficiently direct an upwards airflow 230 under the outer thatch shell to quickly dry it out following heavy or prolonged periods of precipitation.

The thatched roof ridge cover is also perforated and louvered (similar to the perforated louvered drainage and drying tray) and is designed to allow the upwards flowing air to escape through vent holes built into for example a ridge cover structure (see FIG. 6 in U.S. Provisional Application 62/577,865 filed on Oct. 27, 2017 to which this PCT application claims priority and which is hereby incorporated by reference).

The resulting modular thatch panels and roof ridge cover can be custom-designed to client's particular needs such as pattern, shape, roof pitch, contours, etc. as needed. When fully assembled, the roof is composed of a plurality of thatched modular panels (i.e. the outer thatch shell).

Although the outer thatch shell could be combined and affixed to most modern roofing materials, the ideal combination would be to a metal or synthetic composite roof having an integrated thermal, water and fire barrier (e.g. "Kingspan KS1000 TS" insulated roof panel).

Figure 1:
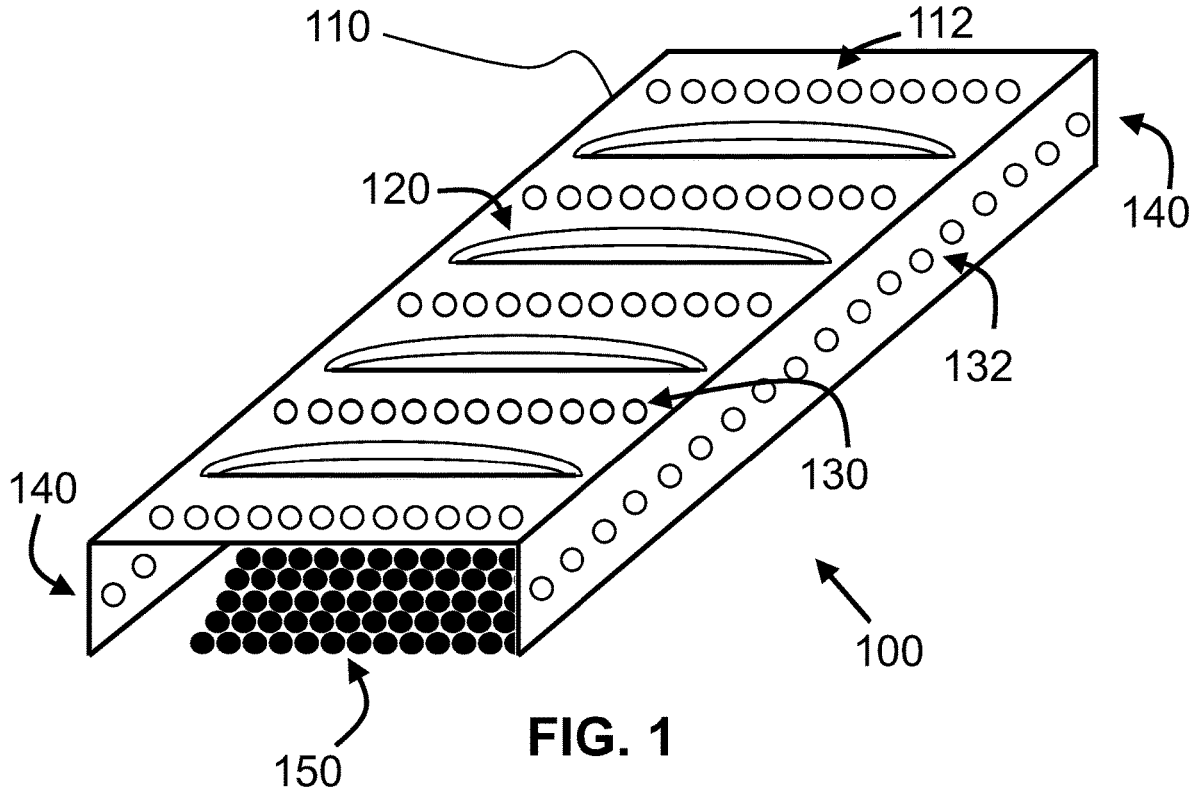
FIGS. 1-2 show according to an exemplary embodiment of the invention an up-side-down view of a single modular thatch panel 100 for a thatch roof (i.e. final assembly of components 110 and 150). The thatch panel distinguishes a perforated louvered drainage and drying tray 110 with louvers 120 at the bottom aspect 112 of the tray and perforations 130 (open circles represent perforations which could be of any shape, form or number) distributed over the tray bottom aspect. Perforations 132 are distributed over the sides 140 which have a purpose to reduce weight of the tray, these perforations 132 do not contribute significantly to drying action of the thatch. The bottom perforations 130 and louvers 120 would face a roof panel 210 with a (water and fire) barrier 220 once installed.

Embodiments of the present invention are achieved through combining three unique and complementary aspects which could encompass one or more methods of the invention based on the aspects either by themselves or based on any combination of the three aspects:

The first aspect and the heart of the present invention's thatching is the modular thatch panel 100, which combines two separate components (FIG. 1):

A compacted "insert thatch bale" 150 made of modern harvested straw or hay, and A "perforated louvered drainage and drying tray" 110.

The thatch panel works as follows:

The compacted straw or hay of the thatch panel is designed specifically to maximize surface rainwater runoff as the primary means of disposing of rainwater by allowing it to flow downwards on the exposed face of the "outer thatch shell" and drain into the top opening of the rain gutter via the leaf screen (see U.S. Provisional Application 62/577,865 filed on Oct. 27, 2017 to which this PCT application claims priority and which is hereby incorporated by reference). However, during unusually heavy or prolonged precipitation, the outer thatch shell is designed to allow excess moisture to safely percolate downwards into the perforated louvered drainage and drying tray. This moisture then drips off the drainage tray and through the air passage onto the upper surface of the modern inner-roof where it drains into the concealed internal drainage system linked to the rain gutter and is safely disposed of (not shown).

Likewise, the design of the bottom end of the perforated louvered drainage and drying tray acts to efficiently direct the upwards air current (from within the air passage 230 between the two roofing components) to flow under the thatch shell to quickly dry it out following heavy or prolonged periods of precipitation.

The second aspect of the present invention's thatching is the compacted insert thatch bale 150 of modern harvested straw or hay and which is affixed into the perforated louvered drainage and drying tray 110. By compacting and mechanically bonding modern harvested straw or hay, this process greatly improves thatch quality by adding several advantageous properties to overcome the aforementioned limitations of modern harvested straw or hay (or any other natural thatching material). These include, but are not limited to:

Compacting and tight bonding significantly reduces porosity, which significantly improves the thatch's ability to efficiently repel and shed rainwater off its outer exposed surface;

Compacting and tight bonding significantly reduces air cavities, which significantly reduces the risk of fire due to lack of oxygen in the thatch bale;

Compacting and tight bonding significantly reduces the risk of damage to the thatch by strong winds;

Compacting and tight bonding improves the longevity of the thatch by minimizing cavities where dampness could occur, thereby significantly reducing the risk of mold and rot forming;

Compacting and tight bonding significantly improves the durability and uniformity of the thatch, thereby negating the need for long overlaps, and likewise reducing the risk of damage to the thatch by vermin or birds or by other physical means.

The third aspect of the present invention's thatching is the manner in which a plurality of thatch panels (i.e. the "outer thatch shell") is fitted over a modern under-roof (existing or newly constructed) and how these two roofing components complement each other. The natural thatch shell provides an aesthetically pleasing look, whereas the modern under-roof provides critical protection from the elements, acts as a fire barrier and provides thermal insulation to meet modern building standards. The two roofing components are fitted together in a manner that creates an effective air passage between them. This air passage enables air to freely pass upwards and underneath the outer thatch shell to accelerate and maintain drying of the thatch. The same air passage also acts to allow excess moisture to drip downwards and onto the upper surface of the modern under-roof to be safely disposed of via the concealed integrated drainage system which drains into a rain gutter.

This PCT application claims the benefit and priority of U.S. Provisional Application 62/577,865 filed on Oct. 27, 2017. U.S. Provisional Application 62/577,865 filed on Oct. 27, 2017 is hereby incorporated by reference.

What is claimed is:

1. A thatch panel for a thatch roof, comprising:

(a) a perforated louvered drainage and drying tray with louvers at a bottom of the perforated louvered drainage and drying tray and perforations distributed over the bottom, wherein the perforated louvered drainage and drying tray has sides defined orthogonal with respect to a roof line of the thatch roof, wherein a bottom surface of the perforated louvered drainage and drying tray faces a barrier which overlays a roof panel, wherein the perforated louvered drainage and drying tray and the barrier are spaced at a distance from each other allowing airflow in between the perforated louvered drainage and drying tray and the barrier; and (b) an insert thatch bale compacted, bonded and inserted in the perforated louvered drainage and drying tray, wherein a bottom surface of the insert thatch bale faces the bottom surface of the perforated louvered drainage and drying tray, and wherein side surfaces of the insert thatch bale face the sides of the perforated louvered drainage and drying tray.

2. The thatch panel as set forth in claim 1, wherein the barrier is a water barrier, a thermal barrier and/or a fire barrier.

3. The thatch panel as set forth in claim 1, wherein the sides of the perforated louvered drainage and drying tray have perforations.

4. The thatch panel as set forth in claim 1, wherein the perforated louvered drainage and drying tray has additional sides defined parallel with respect to the roof line.

5. The thatch panel as set forth in claim 4, wherein the additional sides have perforations.

6. The thatch panel as set forth in claim 1, wherein the perforated louvered drainage and drying tray has one or two additional sides.

* * * * *